US009121128B2

(12) United States Patent
Hong et al.

(10) Patent No.: US 9,121,128 B2
(45) **Date of Patent: *Sep. 1, 2015**

(54) DRYER

(75) Inventors: Sog Kie Hong, Seoul (KR); Jong Seok Kim, Seoul (KR); Sung Min Kim, Seoul (KR); Dae Yun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 298 days.

This patent is subject to a terminal disclaimer.

(21) Appl. No.: 13/580,735

(22) PCT Filed: Feb. 25, 2011

(86) PCT No.: PCT/KR2011/001367

§ 371 (c)(1),
(2), (4) Date: Nov. 6, 2012

(87) PCT Pub. No.: WO2011/105863

PCT Pub. Date: Sep. 1, 2011

(65) Prior Publication Data

US 2013/0042500 A1 Feb. 21, 2013

(30) Foreign Application Priority Data

Feb. 26, 2010 (KR) ..... 10-2010-001-7967

(51) Int. Cl.
*D06F 58/20* (2006.01)
*D06F 58/02* (2006.01)
*D06F 58/04* (2006.01)

(52) U.S. Cl.
CPC ..... *D06F 58/02* (2013.01); *D06F 58/04* (2013.01)

(58) Field of Classification Search
CPC ..... F26B 11/00; F26B 11/02; F26B 21/00; D06F 58/00; D06F 58/20
USPC ..... 34/595, 601, 602, 606, 610; 58/19, 20; 8/149, 159
See application file for complete search history.

(56) References Cited

U.S. PATENT DOCUMENTS

| | | | | | |
|---|---|---|---|---|---|
| 2,798,307 | A | * | 7/1957 | Reiter | 34/610 |
| 4,360,977 | A | * | 11/1982 | Frohbieter | 34/86 |
| 5,062,219 | A | * | 11/1991 | Harris et al. | 34/606 |
| 5,555,647 | A | * | 9/1996 | Torborg et al. | 34/601 |
| 5,771,604 | A | * | 6/1998 | Wunderlich et al. | 34/603 |
| 5,899,005 | A | * | 5/1999 | Chen et al. | 34/528 |
| 7,627,960 | B2 | * | 12/2009 | Beyerle et al. | 34/602 |
| 7,992,322 | B2 | * | 8/2011 | Kim | 34/595 |

(Continued)

FOREIGN PATENT DOCUMENTS

| | | |
|---|---|---|
| JP | 1-288300 | 11/1989 |
| WO | WO 2008/038959 | 4/2008 |

OTHER PUBLICATIONS

International Search Report issued in PCT Application No. PCT/KR2011/001367 dated Aug. 16, 2011.

*Primary Examiner* — Stephen M Gravini
(74) *Attorney, Agent, or Firm* — Ked & Associates, LLP

(57) ABSTRACT

A dryer is provided. The dryer (1) includes a cabinet (10), a drum (11), a rear supporter (30), and a dry duct (42). The cabinet (10) defines an external appearance. The drum (21) is rotatably provided in the cabinet an housing articles to be dried. The rear supporter (30) supports a rear end of the drum (21). The dry duct (42) supplies dry air. Here, the dry duct (42) is connected to a circumference of the rear supporter (30) to supply the dry air into the drum through the circumference of the rear supporter.

13 Claims, 7 Drawing Sheets

(56) References Cited

U.S. PATENT DOCUMENTS

| | | | | |
|---|---|---|---|---|
| 8,112,904 | B2 * | 2/2012 | Kono et al. | 34/595 |
| 8,261,466 | B2 * | 9/2012 | Latack et al. | 34/601 |
| 8,387,274 | B2 * | 3/2013 | Ashrafzadeh et al. | 34/528 |
| 8,555,522 | B2 * | 10/2013 | Bellinger et al. | 34/549 |
| 8,732,979 | B2 * | 5/2014 | Ashrafzadeh et al. | 34/601 |
| 8,776,394 | B2 * | 7/2014 | Catauro et al. | 34/601 |
| 2004/0123487 | A1 | 7/2004 | Han | |
| 2006/0086001 | A1 * | 4/2006 | Jeong et al. | 34/606 |
| 2006/0162394 | A1 * | 7/2006 | Kim et al. | 68/20 |
| 2007/0044522 | A1 * | 3/2007 | Kim et al. | 68/140 |
| 2007/0163144 | A1 | 7/2007 | Dittmer et al. | |
| 2013/0042500 | A1 * | 2/2013 | Hong et al. | 34/604 |
| 2013/0118027 | A1 * | 5/2013 | Ashrafzadeh et al. | 34/443 |
| 2013/0239434 | A1 * | 9/2013 | Bellinetto et al. | 34/549 |
| 2013/0318813 | A1 * | 12/2013 | Hong et al. | 34/380 |
| 2014/0033559 | A1 * | 2/2014 | Bellinger et al. | 34/282 |
| 2014/0150279 | A1 * | 6/2014 | Kwon et al. | 34/82 |
| 2014/0157613 | A1 * | 6/2014 | Mclain | 34/139 |
| 2014/0182159 | A1 * | 7/2014 | Shin et al. | 34/130 |

* cited by examiner

DRYER

CROSS-REFERENCE TO RELATED PATENT APPLICATIONS

This application is a U.S. National Stage Application under 35 U.S.C. §371 of PCT Application No. PCT/KR2011/001367, filed Feb. 25, 2011, which claims priority to Korean Patent Application No. 10-2010-0017967, filed Feb. 26, 2010, whose entire disclosures are hereby incorporated by reference.

TECHNICAL FIELD

The present invention relates to a dryer with a larger capacity for articles to be dried.

BACKGROUND ART

Generally, dryers include a drum for receiving drying matters, a driving source for driving the drum, a heating source for heating air flowing into the drum, and a blower for suctioning or discharging air into/from the drum.

Dryers may be classified into electric-type dryers and gas-type dryers according to heating means for heating air. The electric-type dryers heat air using electric resistance heat, whereas the gas-type dryers heat air using heat generated by the combustion of gas.

The dryers may also be classified into condensation-type dryers or exhaust-type dryers. In the condensation-type dryers, air humidified while articles to be dried circulates without being discharged from the dryers. In this case, a separate structure for condensing moisture included in the circulating air into water is provided. On the other hand, in the exhaust-type dryers, air humidified during the drying of articles is directly discharged from the dryer.

In addition, the dryers may be classified into top loading-type dryers or front-loading type dryers according to methods of loading articles to be dried. In the top loading-type dryers, articles are loaded from the top of the dryer. In the front loading-type dryers, articles are loaded from the front of the dryer.

On the other hand, there is a limitation in that the capacity of a drying chamber formed by a drum is reduced due to a passage structure for supplying air into the drum. For example, when a dry duct is provided at the rear of the drum to supply dry air into the drum, a space occupied by the dry duct restricts the longitudinal length of the drum, and thus the increase of the capacity of the drum is restricted. Accordingly, it is necessary to devise a method for increasing the capacity of the drying chamber formed by the drum, by improving the passage structure for supplying air into the drum.

DISCLOSURE OF INVENTION

Technical Problem

Accordingly, the present invention is directed to a dryer that substantially obviates one or more of the problems due to limitations and disadvantages of the related art.

An object of the present invention is to provide a dryer with a larger capacity for articles to be dried.

Another object of the present invention is to provide a dryer with improved space utilization therein.

The objects of the present invention are not limited to the objects mentioned above, and other objects that have not been mentioned herein can be clearly understood from the following description by those skilled in the art.

Solution to Problem

To achieve these and other advantages and in accordance with the purpose of the present invention, as embodied and broadly described, there is provided a dryer including: a cabinet defining an external appearance; a drum rotatably provided in the cabinet and loading articles to be dried; a rear supporter supporting a rear end of the drum; and a dry duct supplying dry air, wherein the dry duct is connected to a circumference of the rear supporter to supply the dry air into the drum through the circumference of the rear supporter.

According to another aspect of the present invention, there is provided a dryer including: a cabinet defining an external appearance; a drum rotatably provided in the cabinet and loading articles to be dried; a rear supporter supporting a rear end of the drum; and a dry duct supplying dry air, wherein the dry duct is connected to a circumference of the rear supporter to supply the dry air into the drum through the circumference of the rear supporter.

Advantageous Effects of Invention

According to the present invention, the capacity of a dryer for articles to be dried can be increased.

Also, dry air can be supplied into a drum through the circumference of a supporter for supporting the drum, thereby increasing the length of the drum.

In addition, since dry air is supplied in a radial direction of a rear supporter through a dry duct, the internal space utilization of the dryer can be improved.

BEST MODE FOR CARRYING OUT THE INVENTION

Figure 1:
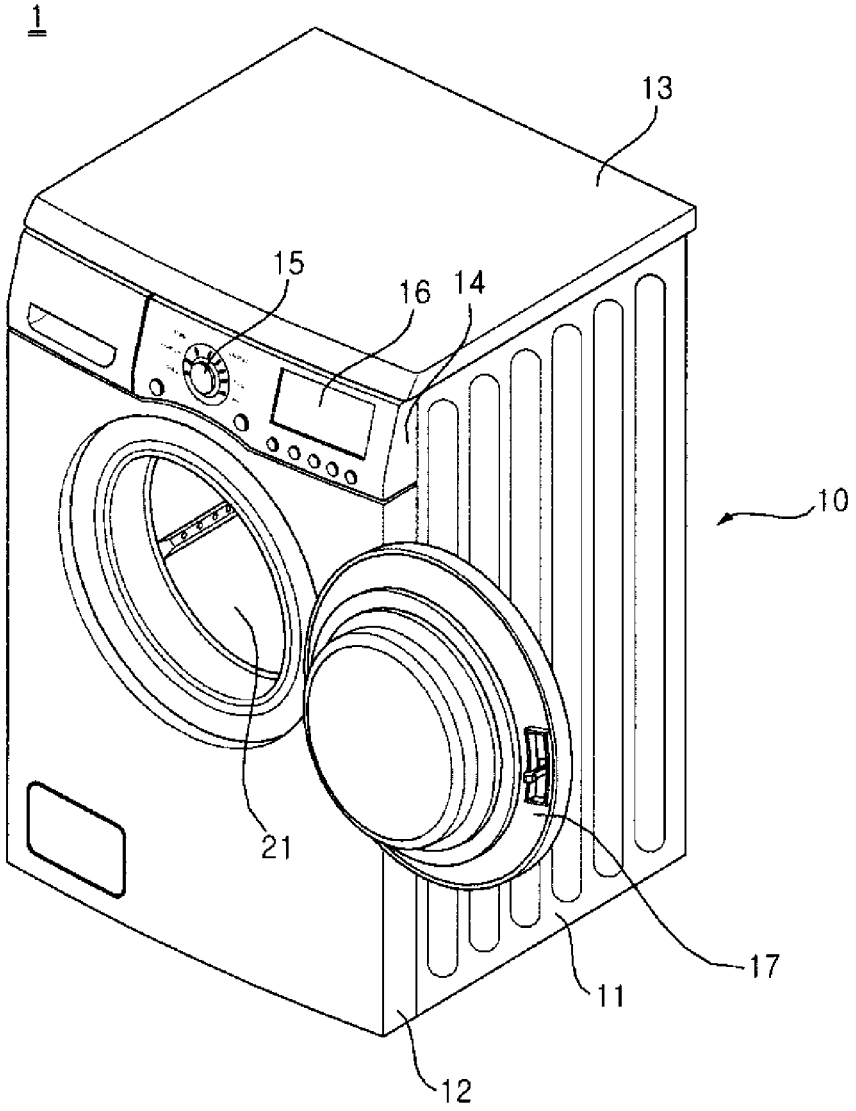
FIG. 1 is a perspective view illustrating a dryer according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Figure 2:
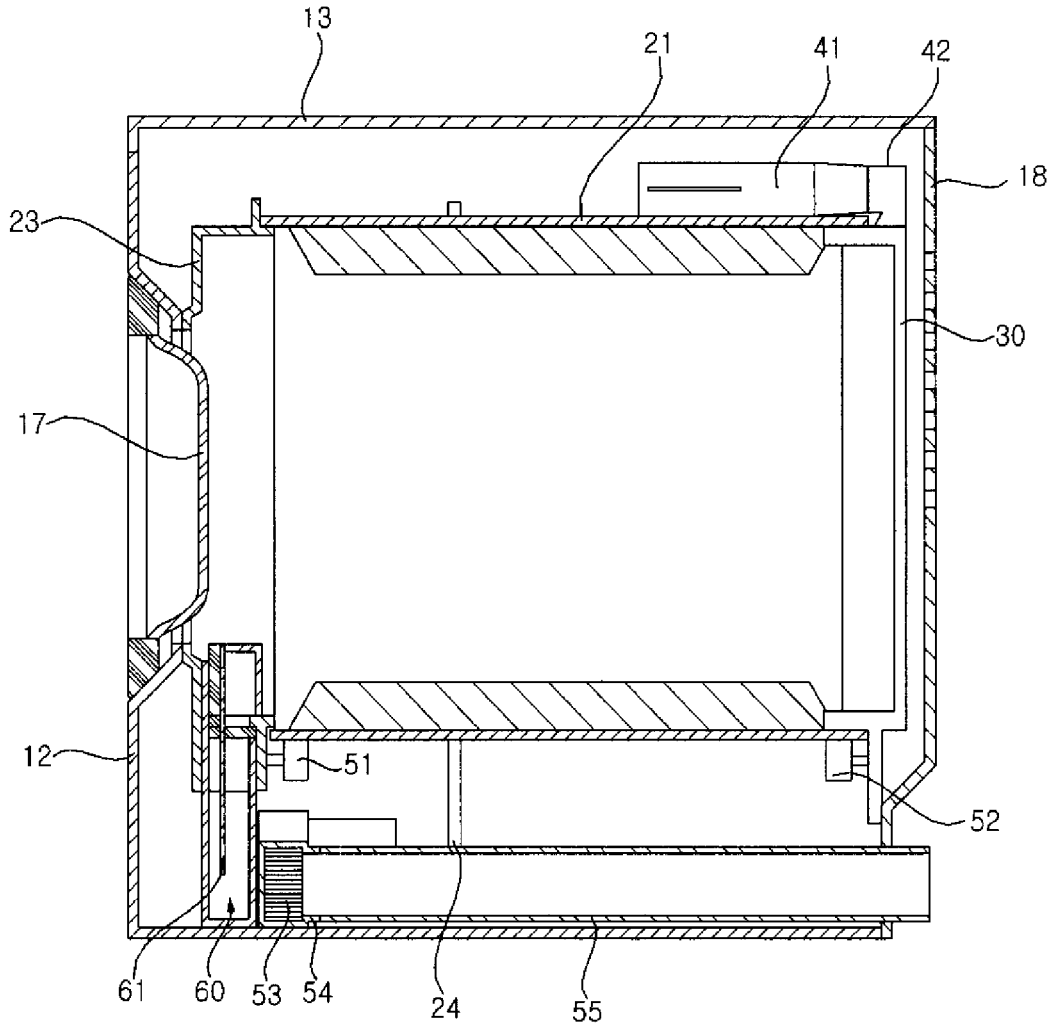
FIG. 2 is a side cross-sectional view illustrating the dryer shown in FIG. 1.
Figure 3:
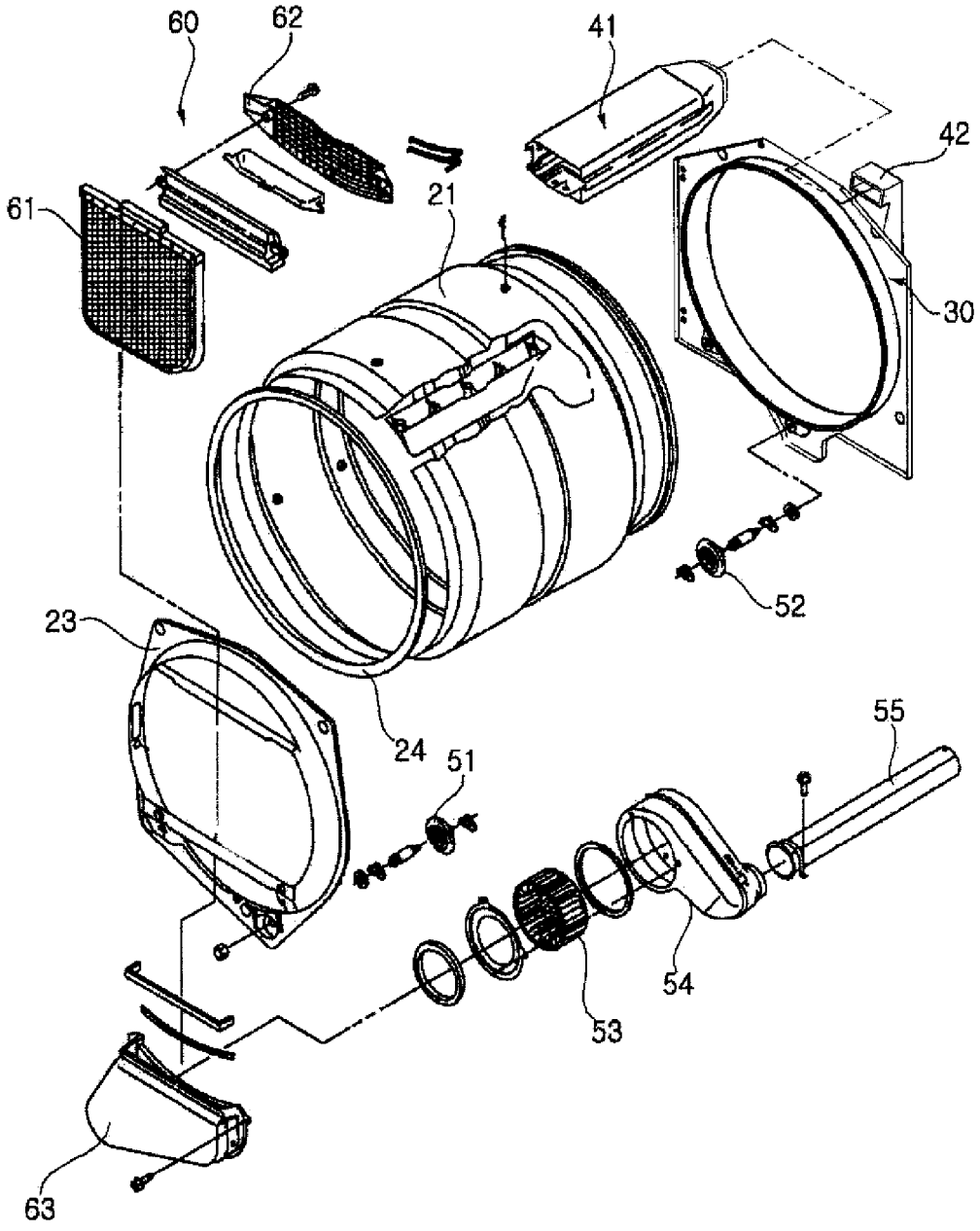
FIG. 3 is an exploded perspective view illustrating the dryer shown in FIG. 1.

FIG. 1 is a perspective view illustrating a dryer according to an embodiment of the present invention. FIG. 2 is a side cross-sectional view illustrating the dryer shown in FIG. 1. FIG. 3 is an exploded perspective view illustrating the dryer shown in FIG. 1.

Referring to FIGS. 1 through 3, a dryer 1 may include a cabinet 10 and a drum 21 that is rotatably provided in the cabinet 10 and loads articles to be dried such as wet laundry.

The cabinet 10, which defines the external appearance of the dryer 1, may include a cabinet main body 11, a front cover 12 that is coupled to the front of the cabinet main body 11 and has a loading hole (not indicated) formed at a substantially central portion thereof to allow articles to be loaded or unloaded, a back panel 18 coupled to the rear of the cabinet main body 11, a control panel 14 provided on the upper end of the front cover 12, and a top cover 13 coupled to the top of the cabinet main body 11.

A door 17 may be rotatably provided in the front cover 12 to open or close the loading hole. An input unit 15 may be provided on the control panel 14 to receive various control commands concerning the operation of the dryer 1 from a user. Also, a display unit 16 may be provided on the control panel 14 to display various kinds of information about the operational state of the dryer 1.

At least one supporter may be disposed in the cabinet 10 to support the drum 21. The supporter may include a front support 23 for supporting the front end of the drum 21 and a rear supporter 30 for supporting the rear end of the drum 21.

The drum 21 may be disposed in the cabinet 10 while being supported by the front supporter 23 and the rear supporter 30, and may be rotated by a belt 24 surrounding the circumference of the drum 21. A front roller 51 and a rear roller 52 may be provided at the front supporter 23 and the rear supporter 30, respectively, to allow the drum 21 to smoothly rotate.

A motor (not shown) may be disposed to provide a rotational force for rotating the belt 24. The motor may rotate a blower 53, as well as the belt 24. In this case, the rotational force generated during the rotation of the motor may be delivered by the belt 24 to rotate the drum 21 and the blower 53 and thereby allow air flowing along a heating unit 41, a dry duct 52, the drum 21, a filter assembly 60, and an exhaust duct 55 to be discharged from the dryer 1.

The filter assembly 60, which is for removing foreign substances such as lint that is included in the air having passed the drum 21, may include a filter 61 having a fine net-shaped structure, a filter cover 63 guiding air having passed the filter 61 to the blower 53, and a bracket 62 coupling the filter 61 with the filter cover 63.

Air filtered through the filter assembly 60 may be transferred to the exhaust duct 55 by a suctioning force generated during the rotation of the blower 53.

The blower 53 may be rotatably provided in a blower casing 54. Air blown by the blower 53 may be guided to the exhaust duct 55 along the blower casing 54, and then discharged from the dryer 1.

As shown in FIG. 3, the blower 53 may include a centrifugal fan that blows air in a circumferential direction by a centrifugal force, but embodiments are not limited thereto. For example, other types of fan may be applied according to modifications of an exhaust flow configuration connecting between the drum 21 and the exhaust duct 55.

The dry duct 42 may be connected to the circumference of the rear supporter 30. In this case, an outlet may be formed in the rear supporter 30 to allow air guided through the dry duct 42 to be supplied to the drum through the outlet.

A process in which articles are dried in the dryer 1 according to an embodiment of the present invention will be described below.

During drying process, an air flow that flows through the heat unit 41, the dry duct 42, the drum 21, the filter assembly 60, the blower 53, and the exhaust duct 55 may be formed to dry articles loaded in the drum 21.

More specifically, the dryer 1 may perform hot-air drying in which hot air is introduced into the drum 21, and cold-air drying in which cold air of low or normal temperature is supplied. The hot-air drying and the cold-air drying may differ in whether air introduced into the drum 21 is heated by the heating unit 41, but may be similar in air flow path. Hereinafter, hot-air drying during which the heating unit 41 operates will be described.

When an operation command is inputted by a user through the input unit 15, the heating unit 41 may operate, and the blower 53 may rotate. The blower 53 may generate a wind pressure such that air in the cabinet 10 sequentially flows through the heating unit 41, the dry duct 42, the drum 21, the filter assembly 60, the blower 53, and the exhaust duct 55.

Air heated by the heating unit 41 may be guided to the circumference of the rear supporter 30 through the dry duct 42 connecting between the heating unit 41 and the circumference of the rear supporter 30, and then may be discharged into the drum 21 through an outlet formed in the rear supporter 30. Articles to be dried may be dried by the air discharged into the drum 21. While air humidified after drying the articles in the drum 21 is passing through the filter 61, foreign substances such as lint may be removed from the air, and the filtered air may be discharged to the outside through the exhaust duct 55.

The dryer 1 according to the embodiment of the present invention is an exhaust-type dryer in which air humidified after drying the articles in the drum 21 is discharged from the dryer 1 through the exhaust duct 55. However, a condensation-type dyer in which articles are dried using air circulating in the dryer without exhausting, and moisture is removed from the circulating air by applying cold water to a circulation passage of the air to condense the moisture included in the air having passed a drum will do within the scope that the spirit of the present invention covers.

Figure 4A:
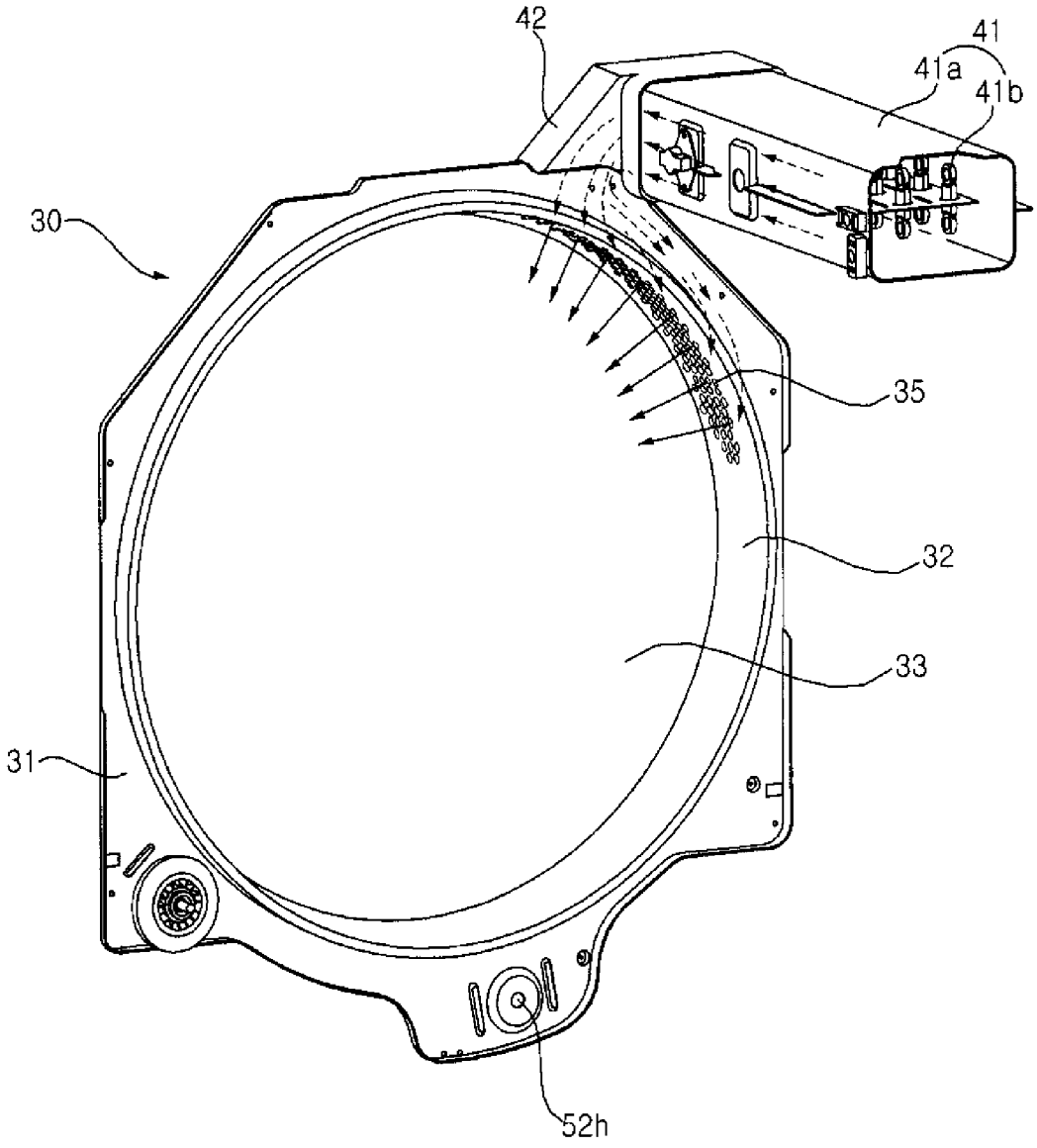
FIG. 4*a* is a magnified perspective view illustrating a rear supporter shown in FIG. 3.

FIG. **4*a* is a perspective view illustrating the rear supporter shown in FIG. 3. Referring to FIG. 4*a*, the rear supporter 30 may rotatably support the rear end of the drum 21, and may define a drying chamber loading articles to be dried together with the drum 21**.

The rear supporter may include a partition 33 covering the rear of the drum 21, and a rim 32 formed substantially perpendicular to the partition 33 to allow the rear end of the drum 21 to be rotatably coupled thereto and having a width extending in a direction of the axis of rotation of the drum 21.

A support frame 31 formed along the circumference of the rim 32 may be coupled to the inside of the cabinet 10 to fix the rear supporter 30. A coupling hole **52*h* to which the rear roller 52 is rotatably coupled may be formed in the support frame 31. The support frame 31 may be coupled to any of the cabinet main body 11 and the back panel 18**.

In the dryer 1 according to the present embodiment, the dry duct 42 may be connected to the circumference of the rear supporter 30 to supply dry air into the drum 21 through the circumference of the rear supporter 30. More specifically, when an extending direction of the rim 32 extending in a ring-shape corresponding to the circumference of the drum is defined as a circumferential direction, a direction that is perpendicular to the inner circumferential surface of the rim 32 and faces the axis of rotation of the drum 21 is defined as a radial direction, the dry duct 42 may be connected to the circumference of the rear supporter 30 extending to the circumferential direction. Dry air supplied through the dry duct 42 may flow along the radial direction to pass a plurality of outlets 35 formed in the rim 32. In this case, since the outlets 35 are arranged along the circumferential direction on the rim 32, the respective outlets 35 may discharge dry air into the drum 21 in the radial direction.

Also, a guide passage (not indicated) may be provided to guide dry air supplied through the dry duct 42 to the outlet 35. The guide passage may be formed integrally with the rear supporter 30 to communicate between the dry duct 42 and the outlet 35, and may also be formed integrally with the dry duct 42. Also, the guide passage may be formed separately from the rear supporter 30 and the dry duct 42 and communicates between the dry duct 42 and the outlet 35.

As shown in FIG. 4*a*, the outlet 35 may be formed at an upper portion of the rim 32 such that heated air is discharged to an upper portion of the inside of the drum 21. In this case, the dry duct 42 may be connected to the upper portion of the rear supporter 30.

As the dry duct 42 is connected to the upper portion of the rear supporter 30, the heating unit 41 may be formed between an upper side of the drum 21 and the cabinet 10 to efficiently utilize the internal space of the cabinet 10.

The heating unit 41 may include a heater casing 41*a* and a heater 41*b* disposed in the heater casing 41*a*. The heater 41*b* may be implemented using various kinds of heaters such as sheath heaters, pin heaters, infrared heaters, quartz tube heaters, or molding heaters.

In the present embodiment, air heated by the heater 41*b* may be introduced in the radial direction of the rear supporter 30 through the dry duct 42. Since the introduced air is discharged into the drum 21 through the outlet 35 formed in the rim 32, there is no need to configure a separate passage in the partition 33 of the rear supporter 30.

Particularly, due to the morphological characteristics of the drum 21 having a cylindrical shape, a certain space may be formed between the outer circumference of the drum 21 and the cabinet 21. Dry air may be guided using the certain space, and the guided air may be supplied into the drum 21 along the circumference of the rear supporter 30. Accordingly, there is no need to configure a dry passage between the rear of the rear supporter 30 and the back panel 18, and thus the axial length of the drum 21 can increase, thereby increasing the total capacity of the drum 21.

Figure 4B:
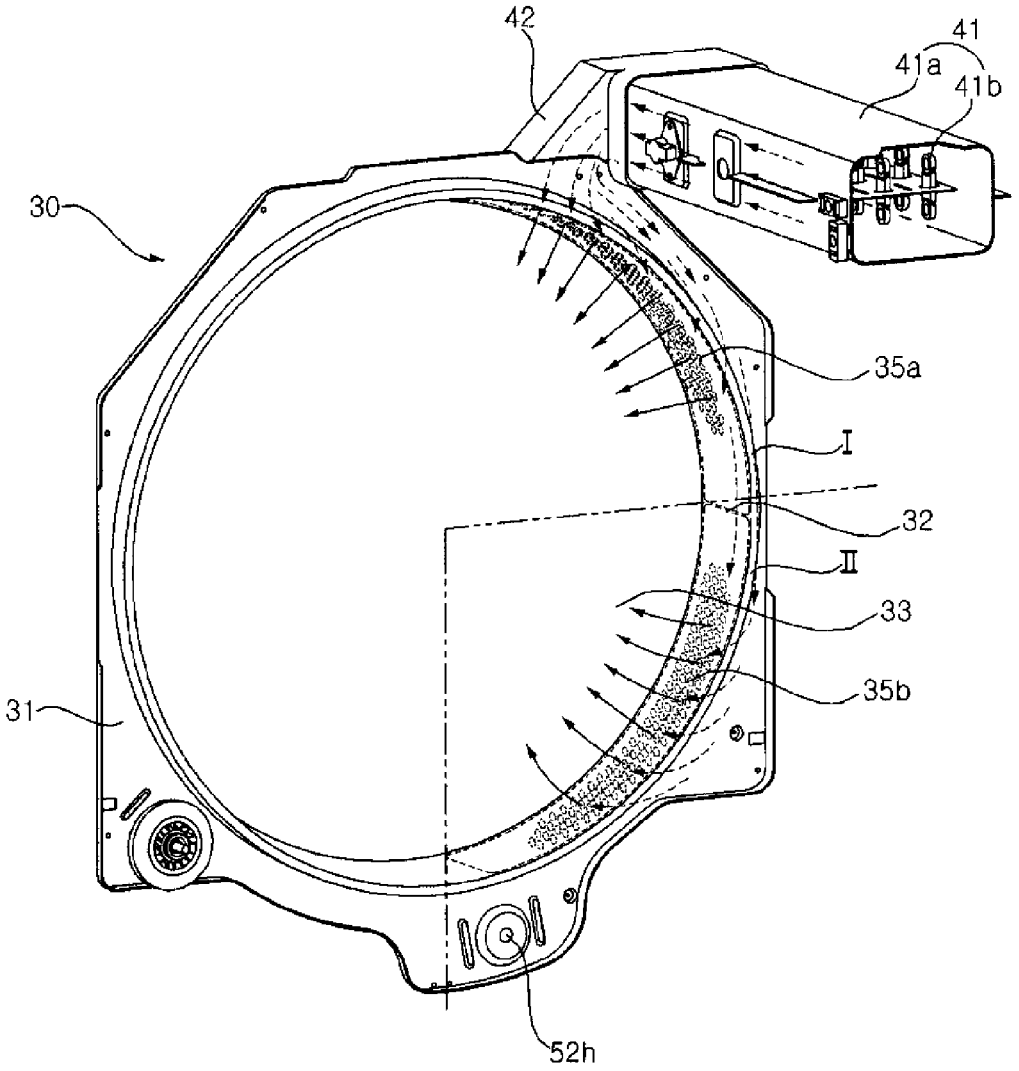
FIG. 4*b* is a perspective view illustrating a modification of the rear supporter shown in FIG. 4*a*.

FIG. 4*b* is a perspective view illustrating a modification of the rear supporter shown in FIG. 4*a*. Referring to FIG. 4*b*, the outlet 35 may be formed at a lower portion II of the rim 32 without being limited an upper portion I of the rim 32.

Since forming the outlet 35*a* at the upper portion of the rim 32 has been described with reference to FIG. 4*a*, a detailed description thereof will be omitted below.

When the outlets 35*a* and 35*b* are formed at the upper portion I and the lower portion II of the rim 32, respectively, a guide passage may be formed such that heated air supplied from the dry duct 42 may be guided from the upper portion I of the rim 32 to the lower portion II of the rim 32.

When the outlet 35*b* is formed at only the lower portion II of the rim 32, unlike that shown in FIG. 4*b*, the heating unit 41 and the dry duct 42 may be provided at the lower side of the rear supporter 30.

In either case described above, the dry duct 42 may be connected to the circumference of the rear supporter 30, and air supplied through the dry duct 42 may be discharged into the drum in the radial direction through the outlet provided in the rim 32 of the rear supporter 30. Also, the position of the dry duct 42 and the heating unit 41 may be changed in accordance with the position of the outlets formed at the rim 32.

Figure 5:
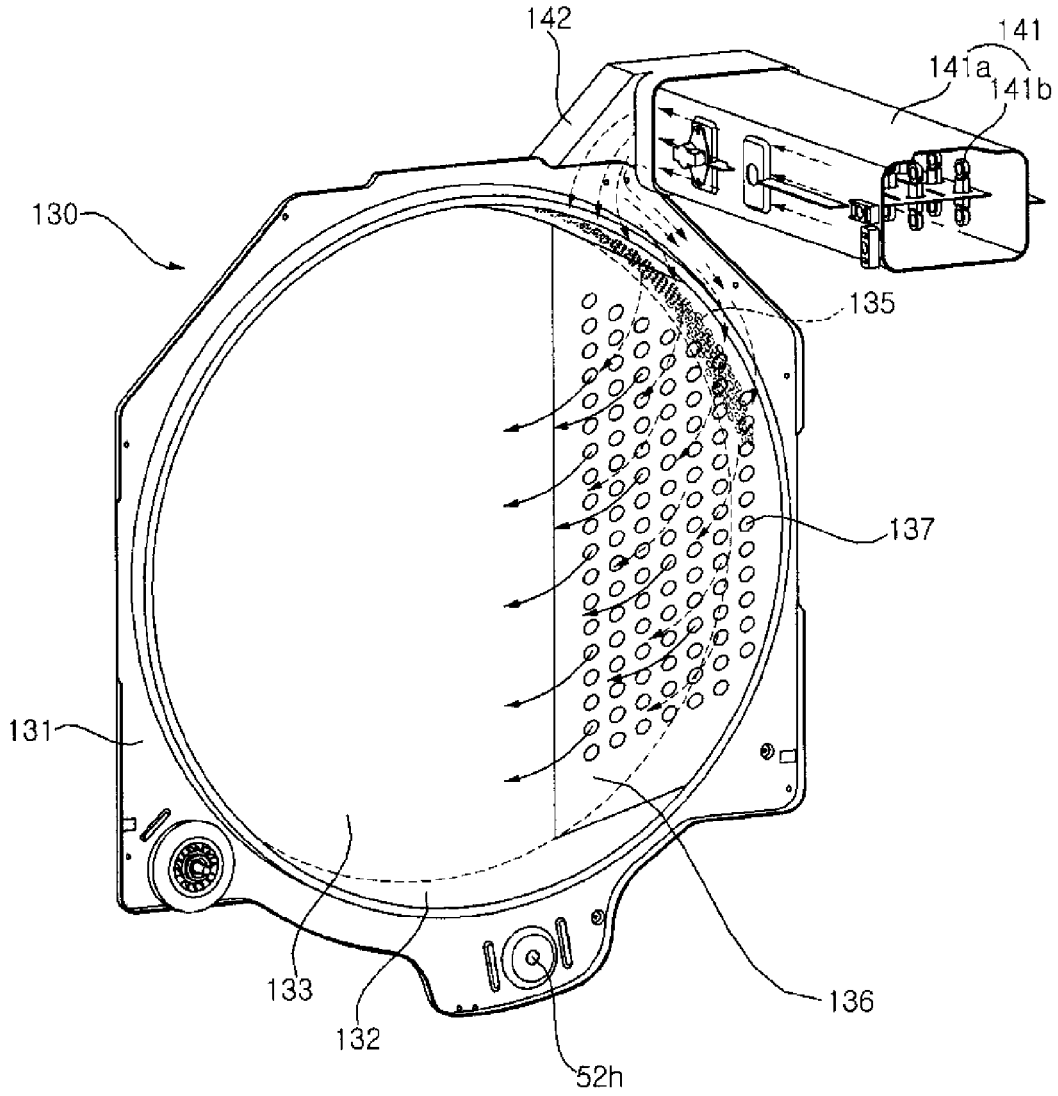
FIG. 5 is a view illustrating a rear supporter according to another embodiment of the present invention.

FIG. 5 is a view illustrating a rear supporter according to another embodiment of the present invention.

Hereinafter, a detailed description of configurations identical to or similar to that of the previous embodiment will be omitted.

In a rear supporter 130 according to the present embodiment, a first outlet 135 may be formed at a rim 132. The rear supporter 130 may include an inclined surface 136 extending from the rim 132 to a partition 133. Also, a plurality of second outlets 137 may be formed in the inclined surface 136.

Air discharged through the first outlet 135 may flow into a space formed between the rim 132, the inclined surface 136, and the partition 133, and may be discharged to the substantial front of the drum 21 through the plurality of second outlets 137 formed in the inclined surface 136.

In the present embodiment, the heating unit 141 and the dry duct 142 may be provided at a right upper portion of the rear supporter 130, and thus at least one first outlet 135 may be formed at a right upper portion of the rim 132. The inclines surface 136 may extend from a right portion of the rim 132 to the partition 133, but embodiments are not limited thereto. For example, the position where the inclined surface 136 is formed may vary according to the arrangement of the heating 141, the dry duct 141, and/or the first outlet 135.

Figure 6:
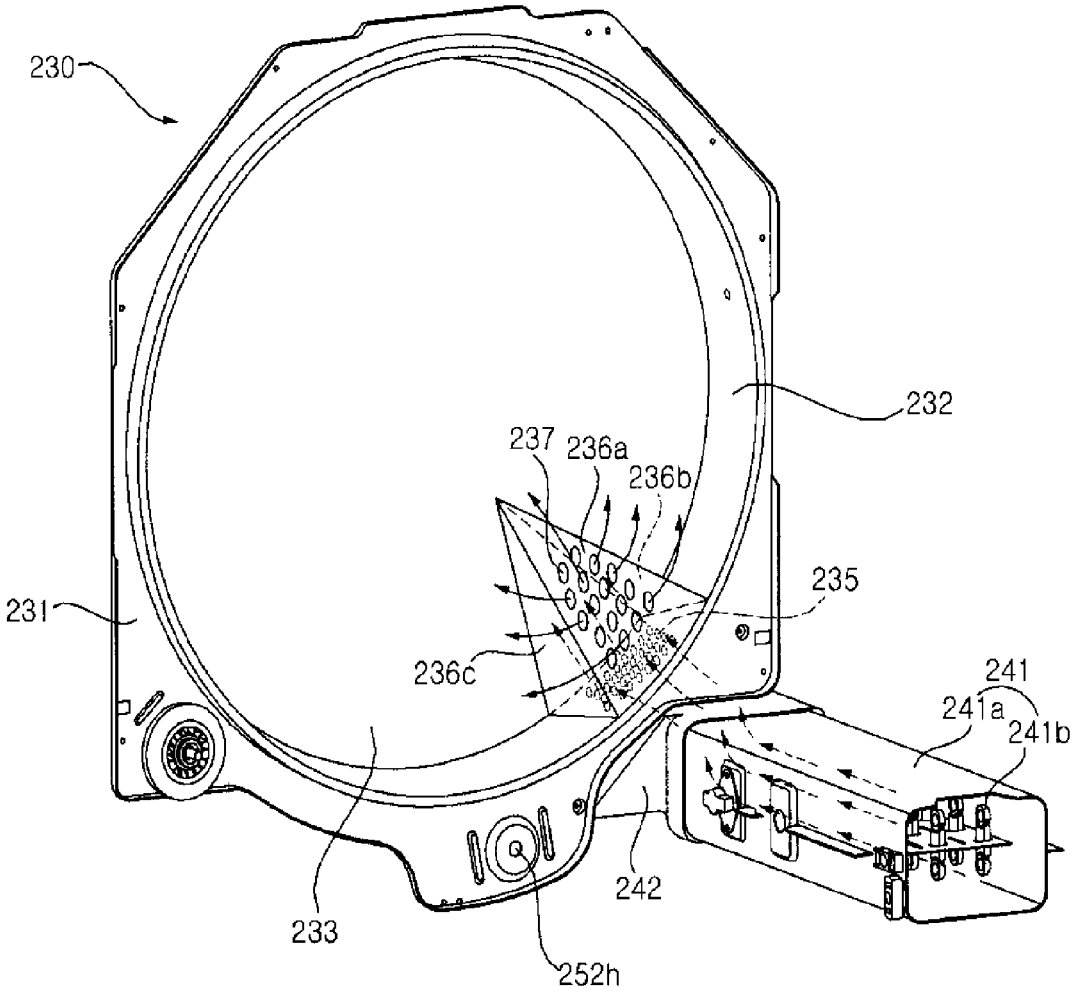
FIG. 6 is a view illustrating a rear supporter according to still another embodiment of the present invention.

FIG. 6 is a view illustrating a rear supporter according to still another embodiment of the present invention. Hereinafter, a detailed description of configurations identical to or similar to those of previous embodiments will be omitted.

Referring to FIG. 6, in a rear supporter 230 according to still another embodiment of the present invention, a first outlet 235 may be formed at a lower portion of a rim 232, and an inclined surface 236*a* may be formed at a lower portion of the rear supporter 230.

The inclined surface 236*a* may be similar to the inclined surface 136 shown in FIG. 5 in that the inclined surface 236*a* declines from the rim 232 to a partition 233, but may be different from the inclined surface 136 in that the inclined surface 236*a* extends from a lower portion of the rear supporter 230 to the partition 233, and thus a heating unit 241 and a dry duct 242 are also provided at a lower side of the rear supporter 230.

Also, since the inclined surface 236*a* may have a substantial fan-shape, the position and area of the inclined surface 236*a* may be restricted compared to the inclined surface 136 described above. A gap may be generated when the rim 232 and the partition 233 are connected to each other by the inclined surface 236*a*. In order to seal the gap, a first surface 236*b* and a second surface 236*c* may extend from both sides of the inclined surface 236*a* to the partition 233, respectively.

Air discharged from the first outlet 235 may flow into a space formed by the rim 232, the inclined surface 236*a*, the first surface 236*b*, the second surface 236*c*, and the partition 233, and may be discharged to the substantial front of the drum 21 through the plurality of second outlets 237 formed at the inclined surface 236*a*.

Since articles to be dried in the drum 21 slide along the inclined surface 236*a* due to their weight, the plurality of second outlet 237 formed in the inclined surface 236*a* may be prevented from being blocked by the articles. Accordingly, the drying performance can be improved.

Also, the structure in which the inclined surface 236*a* declines from the rim 232 to the partition 233 may allow articles to slide and move to the front of the drum 21 in terms of how the location of the articles to be dried changes.

Accordingly, such a structure has an effect of preventing articles to be dried from being tangled at the side of the rear supporter 230.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A dryer comprising:

a cabinet defining an external appearance;

a drum rotatably provided in the cabinet and loading articles to be dried;

a rear supporter supporting a rear end of the drum, the rear supporter being stationary disposed; and a dry duct supplying dry air, wherein the dry duct is connected to a circumference of the rear supporter to supply the dry air into the drum through the circumference of the rear supporter, wherein the rear supporter includes a rim having a width extending along an axial direction of rotation of the drum, and the rim has at least one outlet discharging the air supplied from the dry duct into the drum.

2. The dryer of claim 1, wherein the rear supporter further comprises a guide passage guiding the air supplied from the dry duct to the outlet.

3. The dryer of claim 2, wherein the guide passage is formed integrally with the rear supporter.

4. The dryer of claim 1, wherein the outlet is formed at an upper portion of the rim such that air is discharged into an upper portion of the inside of the drum.

5. The dryer of claim 1, wherein the dry duct is disposed between an outer circumference of the drum and the cabinet.

6. A dryer comprising:

a cabinet defining an external appearance;

a drum rotatably provided in the cabinet and loading articles to be dried;

a rear supporter supporting a rear end of the drum, the rear supporter being stationary disposed; and a dry duct supplying dry air, wherein the dry duct is connected to a circumference of the rear supporter to supply the dry air into the drum through the circumference of the rear supporter, and wherein the rear supporter comprises:

a partition covering the rear of the drum;

a rim formed at the partition such that the rear end of the drum is rotatably coupled thereto, and having a width extending along an axial direction of rotation of the drum;

at least one first outlet formed at the rim and discharging the air supplied from the dry duct; and an inclined surface declining from the rim to the partition and having at least one second outlet such that the air from the first outlet is discharged toward a front of the drum.

7. The dryer of claim 6, wherein the inclined surface declines from a lower portion of the rim to the partition.

8. The dryer of claim 1, further comprising a heating unit connected to the dry duct, wherein the heating unit is disposed between an outer circumference of the drum and the cabinet.

9. The dryer of claim 1, further comprising a front supporter that rotatably supports a front end of the drum.

10. A dryer comprising:

a cabinet defining an external appearance;

a drum rotatably provided in the cabinet and loading articles to be dried;

a rear supporter supporting a rear end of the drum, the rear supporter being stationary disposed; and a dry duct supplying dry air, wherein the dry duct is connected to a circumference of the rear supporter to supply the dry air from the dry duct in a radial direction of the rear supporter, wherein the rear supporter includes a rim having a width extending along an axial direction of rotation of the drum, and the rim has at least one outlet discharging the air supplied from the dry duct into the drum.

11. The dryer of claim 10, wherein the rear supporter discharges the dry air supplied in the radial direction of the rear supporter toward a front of the drum.

12. A dryer comprising:

a cabinet defining an external appearance;

a drum rotatably provided in the cabinet and loading articles to be dried;

a rear supporter supporting a rear end of the drum, the rear supporter being stationary disposed; and a dry duct supplying dry air, wherein the dry duct is connected to a circumference of the rear supporter to supply the dry air from the dry duct in a radial direction of the rear supporter, and wherein the rear supporter comprises:

a partition covering the rear of the drum;

a rim formed at the partition such that the rear end of the drum is rotatably coupled thereto, and having a width extending along an axial direction of rotation of the drum;

at least one first outlet formed at the rim and discharging the air supplied from the dry duct; and an inclined surface declining from the rim to the partition and having at least one second outlet such that the air from the first outlet is discharged toward a front of the drum, such that the articles to be dried in the drum slide along an inclination.

13. The dryer of claim 10, further comprising a heating unit disposed between an outer circumference of the drum and the cabinet, wherein the dry duct communicates between the heating unit and the rear supporter.

* * * * *

UNITED STATES PATENT AND TRADEMARK OFFICE

CERTIFICATE OF CORRECTION

PATENT NO. : 9,121,128 B2
APPLICATION NO. : 13/580735
DATED : September 1, 2015
INVENTOR(S) : Sog Kie Hong et al.

It is certified that error appears in the above-identified patent and that said Letters Patent is hereby corrected as shown below:

Title page item (30) should read as follows

(30) Foreign Application Priority Data

Feb. 26, 2010 (KR) ..... 10-2010-0017967

Signed and Sealed this
Twenty-ninth Day of March, 2016

Michelle K. Lee

Michelle K. Lee
*Director of the United States Patent and Trademark Office*